United States Patent [19]

Elorza

[11] Patent Number: 4,505,216

[45] Date of Patent: Mar. 19, 1985

[54] APPARATUS FOR PILOTING SAILBOARDS

[76] Inventor: Ramon H. Elorza, Rios Rosas 19, Madrid, Spain

[21] Appl. No.: 480,326

[22] Filed: Mar. 30, 1983

[30] Foreign Application Priority Data

Mar. 30, 1982 [ES] Spain ..... 264.239

[51] Int. Cl.[3] ..... B63B 35/00

[52] U.S. Cl. ..... 114/39

[58] Field of Search ..... 114/39, 97, 98, 230, 114/39.2; 441/74; 182/3, 4

[56] References Cited

U.S. PATENT DOCUMENTS 1,539,729 5/1925 Gold ..... 182/4

2,561,487 7/1951 Bailhe ..... 114/230

FOREIGN PATENT DOCUMENTS 2916643 11/1980 Fed. Rep. of Germany ..... 441/74

2442641 8/1980 France ..... 114/39

OTHER PUBLICATIONS

"Harness Review"; *Windsurf,* Mar. 1982; pp. 48–51.

*Primary Examiner*—Trygve M. Blix

*Assistant Examiner*—Jesûs D. Sotelo

*Attorney, Agent, or Firm*—Young & Thompson

[57] ABSTRACT

A sailboard with an upstanding mast and a wishbone boom surrounding the mast and extending a sail connected to the mast, is provided with an elongated flexible element secured at its ends one on each side of the boom. The element is vertically swingable about its ends on the boom and is flexible and padded and is urged to raised position by an elastic member that interconnects the element to the mast. The flexible element is of a size suitable to receive within it the user's body so that the user can lean back on the element and thus apply his weight to the boom without the need for using his hands. This relieves strain on the arms and shoulders of the user.

4 Claims, 3 Drawing Figures

APPARATUS FOR PILOTING SAILBOARDS

The present invention relates to apparatus for piloting sailboards of the type known as windsurfers.

Such sailboards are characterized by a mast upstanding from the sailboard, with a sail connected to the mast. A wishbone boom extends on both sides of the sail and about the mast for extending the sail rearwardly of the mast. The user stands on the board and grasps the wishbone boom and leans back, in order to counteract the force of the wind. This causes fatigue in the arms and shoulders of the user.

It is an object of the present invenion to provide a sailboard of the type with a wishbone boom, in which at least some of the strain on the arms of the user is relieved.

Another object of the present invention is to provide a surfboard of the type having a wishbone boom, with means to support the body of the user other than by his arms.

Briefly, the present invention achieves these objects by providing on the wishbone boom a flexible padded element which is pivotally connected at its ends to the wishbone boom by supports, the element being longer than the distance between the supports so that the element is curvilinear in shape. Two such elements are provided, one on the port side and the other on the starboard side of the wishbone boom.

The user of the sailboard equipped with a device according to the present invention, places his torso within and rests his back on the flexible element, thus placing his weight on this element, which transmits it to the wishbone boom. If desired, and if the dimensions of the flexible element make it possible, the sailboard user can rest his buttocks on the element which thus provides a seat on which he can rest.

The pivotal supports that connect the curved flexible element to the wishbone boom, also make it possible to raise the element to a rest position when the board is not in use. A suitable elastic member interconnects the element and the mast thereby automatically tending to raise the element to the rest position.

The flexible element is connected to the wishbone boom at points such that the weight of the user's body tends to be directly opposite the center of force of the wind on the sail.

In this way, the user's weight can be applied with precision to the pivotal supports by which the flexible element is secured to the wishbone boom, thereby achieving optimum control of the sailboard.

The use of the device according to the present invention is very simple. As indicated above, in rest position, the flexible element is maintained in upwardly swung position by the action of the elastic member that interconnects it to the mast. To place the flexible element in its operative position, the user grasps the flexible element and swings it downwardly about its pivotal supports on the wishbone boom, to the desired position. The elastic member is thus placed under tension, this tension being counteracted by the force exerted on the flexible element by the weight of the user's body.

In use, the user can apply his weight to the sailboard by pressing with his back against the flexible element and need not even hold onto the wishbone boom with his hands. In fact, the force that can be exerted by the user with his body against the flexible element can be all the force that need be exerted on the wishbone boom, thereby making it possible to maneuver the sailboard without the use of the hands.

In view of these features, the apparatus of the present invention has the following advantages over the prior art:

1. It is now possible to sail without the user having his hands on the wishbone boom. The work he need do with his hands can be reduced to zero.

2. The user does not have to be clothed or to wear special accessories in order to use the apparatus.

3. The user can change tack more simply than with the prior art devices, without the period of time for changing tack being noticeably increased.

4. Release is automatic in case the sailboard is overturned by a gust of wind.

Other objects, features and advantages of the present invention will become apparent from a consideration of the following description, taken in connection with the accompanying drawing which shows, by way of nonlimitative example, a preferred embodiment of the present invention, and in which.

Figure 1:
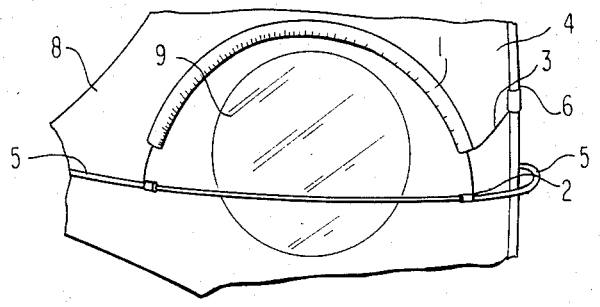
FIG. 1 is a fragmentary view of a sailboard according to the present invention showing the novel structure of the present invention on the starboard side of the sailboard, in its rest position.

Referring now to the drawing in greater detail, it will be seen that the device according to the present invention comprises a flexible, suitably padded element 1 whose length is greater than the distance between pivotal connections 2 by which it is connected at its ends for vertical swinging movement on and relative to the wishbone boom 5 of a sailboard 7, which sailboard 7 with its mast 6, wishbone boom 5 and sail 8 can otherwise be quite conventional.

Figure 2:
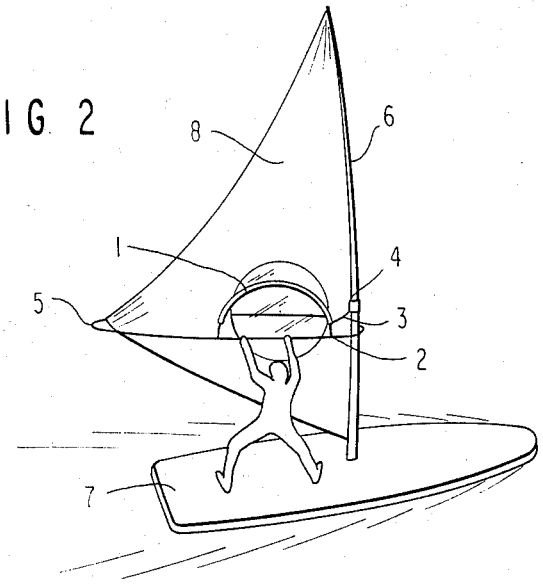
FIG. 2 shows the sailboard in sailing position, with the flexible element again in rest position.

Element 1 is connected to mast 6 by an elastic member 3 that is fastened to mast 6 on support 4. Tie 3 tends to maintain element 1 in the raised position of FIGS. 1 and 2, until the user of the board swings it down to its use position shown in FIG. 3. Needless to say, the flexible element 1, although flexible and padded, should nevertheless have enough rigidity to be self-sustaining in the raised position, so as to maintain its shape shown in FIGS. 1 and 2 and thus be out of the way of the user.

Figure 3:
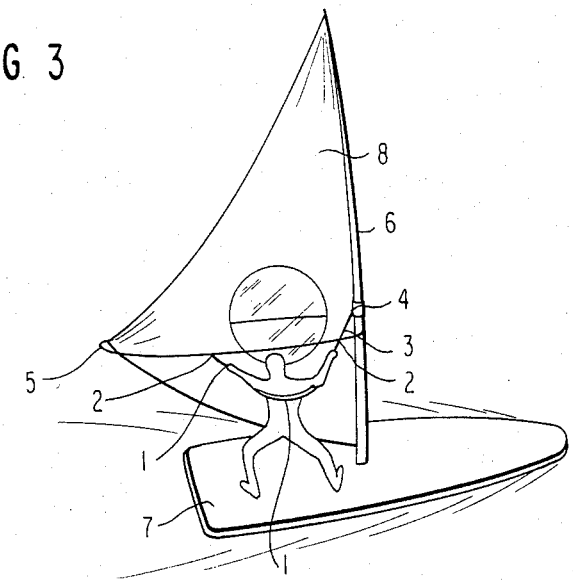
FIG. 3 is a view similar to FIG. 2 but showing the present invention in its use position.

In the normal use of the device, the user rests his back on element 1 as seen in FIG. 3, thereby putting his weight on the element 1, which transmits it through its pivotally connected ends to the wishbone boom 5, with the same result as in existing sailboards that are not provided with the present invention, and with the advantages that have been recited above.

A similar device (not shown) is installed on the port side of a wishbone boom, for obvious reasons.

As is conventional in this type of sailboard, the sail is provided with a window 9 whose characteristics, like those of the sail 8, board 7, mast 6 and wishbone boom 5, are as such totally outside the scope of this invention.

The flexible element 1 is padded to soften its contact with the body of the user and can be widened or even made as a seat for the user, without departing from the invention.

From a consideration of the foregoing disclosure, therefore, it will be evident that all of the initially recited objects of the present invention have been achieved.

Although the present invention has been described and illustrated in connection with preferred embodiments, it is to be understood that modifications and variations may be resorted to, without departing from the spirit of the invention, as those skilled in this art will readily understand. Such modifications and variations are considered to be within the purview and scope of the present invention as defined by the appended claims.

What is claimed is:

1. In a sailboard having an upstanding mast and a wishbone boom surrounding the mast and extending a sail supported by the mast; the improvement comprising an elongated flexible element secured at its two ends to one side of the wishbone mast for vertical swinging movement relative to the boom, said element being curvilinear and of a length greater than the distance between its ends along the boom, and elastic means extending between the element and the boom and tending to swing the element to an inoperative raised position.

2. A sailboard as claimed in claim 1, said element being padded.

3. A sailboard as claimed in claim 1, there being a said element pivotally connected to the starboard side of the wishbone boom and another said element pivotally connected to the port side of the wishbone boom.

4. A sailboard as claimed in claim 1, said element being of a size sufficient to receive the body of the user between the element and the boom with the user's back bearing on the inner side of the element whereby the user can apply his weight to the boom through the element without use of his arms.

* * * * *